US005717285A

United States Patent [19]

Meyer et al.

[11] Patent Number: 5,717,285

[45] Date of Patent: Feb. 10, 1998

[54] MICROTIP DISPLAY DEVICE HAVING A CURRENT LIMITING LAYER AND A CHARGE AVOIDING LAYER

[75] Inventors: Robert Meyer, St. Nazaire les Eymes; Michel Borel, St. Vincent de Mercuze; Brigitte Montmayeul, Brignoud, all of France

[73] Assignee: Commissariat a l 'Energie Atomique, Paris, France

[21] Appl. No.: 618,187

[22] Filed: Mar. 19, 1996

Related U.S. Application Data

[63] Continuation-in-part of Ser. No. 204,981, Mar. 2, 1994, abandoned.

[30] Foreign Application Priority Data

Mar. 17, 1993 [FR] France ..... 93 03072

[51] Int. Cl.[6] ..... H01J 19/24; H01J 29/70; H01J 29/18

[52] U.S. Cl. ..... 313/495; 313/497; 313/308; 313/336; 313/309

[58] Field of Search ..... 313/495, 497, 313/308, 309, 336, 351; 928/917, 690; 315/169.3, 169.4

[56] References Cited

U.S. PATENT DOCUMENTS

| | | | |
|---|---|---|---|
| 3,970,887 | 7/1976 | Smith et al. . | |
| 4,857,161 | 8/1989 | Borel et al. . | |
| 4,908,539 | 3/1990 | Meyer . | |
| 4,940,916 | 7/1990 | Borel et al. . | |
| 4,983,878 | 1/1991 | Lee et al. | 313/308 |
| 5,007,873 | 4/1991 | Goronkin et al. | 313/309 |
| 5,012,482 | 4/1991 | Gray | 313/309 |
| 5,090,932 | 2/1992 | Dieumegard et al. . | |
| 5,151,061 | 9/1992 | Sandhu | 313/309 |
| 5,189,341 | 2/1993 | Itoh et al. | 313/309 |
| 5,191,217 | 3/1993 | Kane et al. | 313/308 |
| 5,194,780 | 3/1993 | Meyer . | |
| 5,235,244 | 8/1993 | Spindt | 313/495 |

FOREIGN PATENT DOCUMENTS

| | | |
|---|---|---|
| 0172089 | 2/1986 | European Pat. Off. . |
| 0461990 | 12/1991 | European Pat. Off. . |
| 8909479 | 10/1989 | WIPO . |

*Primary Examiner*—George M. Dombroske
*Assistant Examiner*—Harshad Patel
*Attorney, Agent, or Firm*—Pearne, Gordon, McCoy & Granger LLP

[57] ABSTRACT

A cathodoluminescent anode is formed on an insulating substrate, while on another insulating substrate are formed cathode conductors, an insulating layer, a grid layer used for the formation of grids, holes in the insulating layer and the grid layer and microtips in the holes. Moreover, a thin insulating layer is formed on the grid layer in order to limit the current liable to flow between the anode and the grids. Another thin layer or film is formed on the thin insulating layer that is sufficiently conductive or resistive to prevent disturbance by the thin electrically insulating layer, of the electric field created between the microtips and the grids.

13 Claims, 3 Drawing Sheets

MICROTIP DISPLAY DEVICE HAVING A CURRENT LIMITING LAYER AND A CHARGE AVOIDING LAYER

This is a continuation-in-part of application Ser. No. 08/204,981, filed Mar. 2, 1994, now abandoned.

BACKGROUND OF THE INVENTION

The present invention relates to a microtip display device and to a process for the production of the device. It more particularly applies to the field of visual display and specifically to flat-faced screens.

Microtip display devices are already known from the following documents to which reference should be made:

(1) French patent application 8601024 of 24.1.1986, corresponding to EP-A-234989 and U.S. Pat. No. 4,857,161;

(2) French patent application 8715432 of 6.11.1987, corresponding to U.S. Pat. No. 4,940,916;

(3) French patent application 9007347 of 13.6.1990, corresponding to EP-A-461990.

A microtip display device comprises a microtip emissive cathode electron source and an electroluminescent anode having a cathodoluminescent material layer positioned facing the microtip emissive cathode electron source, which is more simply known as a "cathode".

Electrical insulation faults are liable to occur between the cathode and the cathodoluminescent anode for the following reasons:

1) the distance between the anode and the cathode is small (a few dozen to a few hundred um, typically 200 μm);

2) the cathodoluminescent material of the anode is generally in powder form, which has an uncertain adhesion, that is, there may be some detachment of the powder;

3) spacers are placed between the anode and the cathode in order to maintain the rigidity of the display device at the time when the vacuum is formed therein, the spacers preferably being in the form of electrically insulating bells, the spacers being liable to constitute weak points with respect to the electrical insulation.

In particular, a detachment of powder, a local degassing or an electrically charged spacer can initiate an electric arc state between the anode and the cathode, which leads to the destruction of the display device over a varyingly large area. This electric arc state phenomenon is all the more liable to occur if the anode voltage applied is high and the distance between the anode and the cathode is small.

In order to improve the performance characteristics of the display device, it is desirable to increase the anode voltage (to increase the brightness of the screen of the device) and reduce the space between the anode and the cathode (so as to be able to use smaller spacers, which are consequently less visible and/or for improving the resolution).

In known microtip display devices, the microtip sources have parallel cathode conductors and grids which are also parallel.

These grids are generally made from metal and in the case of a short-circuit or arc state between the cathodoluminescent anode and the micro-tip source of a device, nothing limits the electric current between the anode and the grids and consequently there is a risk of the device being destroyed.

The object of the invention is to obviate this disadvantage.

SUMMARY OF THE INVENTION

The invention firstly relates to a microtip display device, which has a first electrically insulating substrate carrying a cathodoluminescent anode and a second electrically insulating substrate carrying:

a first series of parallel electrodes acting as cathode conductors and carrying the electron emitter material microtips, an electrically insulating layer on the cathode conductors, a second series of parallel electrodes serving as grids, placed on the insulating layer, holes being formed in the insulating layer and the grids for the passage of the microtips, the device being characterized in that it also comprises on said grids, a first thin layer which is electrically insulating for limiting the electric current liable to flow between the cathodoluminescent anode and the grids and prevent the occurrence of an electric arc between the anode and the grids, the first thin layer also having holes facing the microtips, and in that the first thin layer is associated with means able to avoid the disturbance, by the first thin layer, of the electric field created between the microtips and the grids.

The use of such a first thin layer on the grids of the device makes it possible to greatly reduce the risks of an unsatisfactory operation of the latter, even in the case of an electrical fault.

Preferably, the means able to prevent the disturbance of the electric field incorporate an additional or second thin layer, which covers the first thin layer and which is sufficiently conductive to permit the flow of interfering electric charges liable to be created during the operation of the device and which also has holes facing the microtips.

The second thin layer, which has an adequate electrical conductivity to permit the flow of the charges, can be conductive but, preferably, it is resistive in order to only permit the flow.

The total thickness of the layer or layers formed on the grids can be e.g. between a few dozen and a few hundred nanometers.

Preferably, the diameter of the holes formed in the first thin layer is larger than the diameter of the holes formed in the grids in order to prevent the disturbance of the electric field created between the microtips and the grids, so that the insulating layer is overetched.

Thus, the first thin layer can be overetched and/or covered with the second thin layer which is sufficiently conductive to permit the flow of interfering electrical charges.

This makes it possible to avoid the accumulation of interfering charges in the vicinity of the microtips during the operation of the device.

The device according to the invention can have on the grids, a thin first layer which is insulating, e.g. of silica or silicon nitride, and a second thin layer which is resistive, e.g. of resistive silicon or $SnO_2$.

According to a preferred embodiment of the device according to the invention, the device also has a resistive layer, which is interposed between each cathode conductor and the corresponding microtips, so that the latter rest on the resistive layer. Such a resistive layer is of the type described in the aforementioned documents (2) and (3).

The invention also relates to a process for the production of the micro-tip display device, which also forms the object of the invention, according to which the cathodoluminescent anode is formed on the first substrate and on the second substrate are formed cathode conductors, the first thin layer, a gate layer for the formation of the grids, the holes and then the microtips, the process being characterized in that the first thin layer is also formed on the grid layer and in that the first thin layer is associated with means making it possible to prevent the disturbance, by the first thin layer, of the electric field created between the microtips and the grids.

In the process according to the invention, the grid layer is etched in order to form the grids, advantageously prior to the formation of the holes and the first thin layer or film.

According to an embodiment of the process according to the invention, the first thin layer is formed before the holes.

It is also possible to form on the first thin layer, the second thin layer or film, which is sufficiently conductive to permit the flow of interfering electric charges liable to be created during the operation of the device.

The second thin layer, which is sufficiently conductive to permit the flow of interfering electric charges, can be formed before or advantageously after the stage of forming the holes.

A protective layer can be formed on the first thin layer either directly, or from above the second thin layer, which is sufficiently conductive to permit the flow of charges when it exists. This protective layer can be deposited before or advantageously after the formation of the holes. This protective layer can be eliminated by etching following the microtip formation stage.

As a variant, the protective layer is not or is only partly eliminated following the microtip formation stage.

The layer or layers formed above the grids and which are resistive or conductive can be deposited after the formation of the holes.

BRIEF DESCRIPTION OF THE DRAWINGS

The invention is described in greater detail hereinafter relative to non-limitative embodiments and with reference to the attached drawings, wherein show.

DETAILED DESCRIPTION OF PREFERRED EMBODIMENTS

Figure 1:
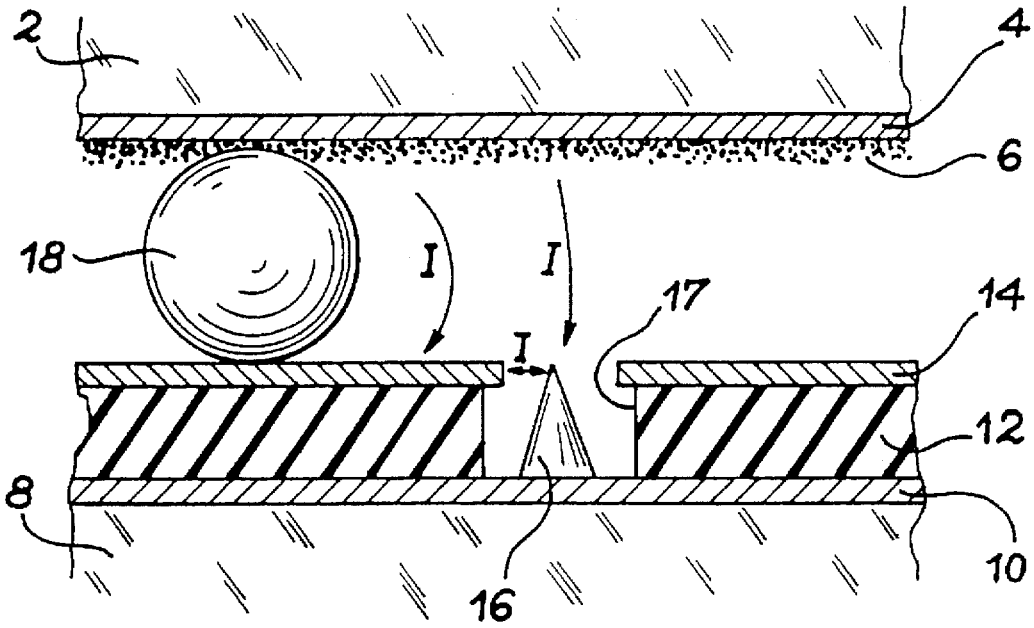
FIG. 1 PRIOR ART
FIG. 1 A partial, diagrammatic view of a known microtip display device.

FIG. 1 diagrammatically and partly shows a known microtip display device. The known device has a cathodoluminescent anode formed on a glass substrate 2 and a conductive, transparent layer 4, e.g. of ITO and, on the layer 4, a luminescent powder layer 6.

The device of FIG. 1 also has a microtip electron source formed on another insulating substrate 8 and having cathode conductors such as the conductor 10, an insulating layer 12 formed on the cathode conductors and grids such as the grid 14, formed on the insulating layer 12 and perpendicular to the cathode conductors 10.

Microtips such as the microtip 16 are formed on the latter, in holes 17 made in the grids and the insulating layer 12.

Moreover, spacers such as the spacer 18 are placed between the cathodoluminescent anode and the grids in order to maintain the rigidity of the device when a vacuum is formed between the cathodoluminescent anode and the microtip electron source.

In this device, in the case of an electrical insulation fault, nothing is provided for limiting the electric current I between the anode and the grids, between the anode and the microtips, and between the microtips and the grids. Such a device is extremely sensitive to short-circuits, is very unstable and is difficult to control.

Figure 2:
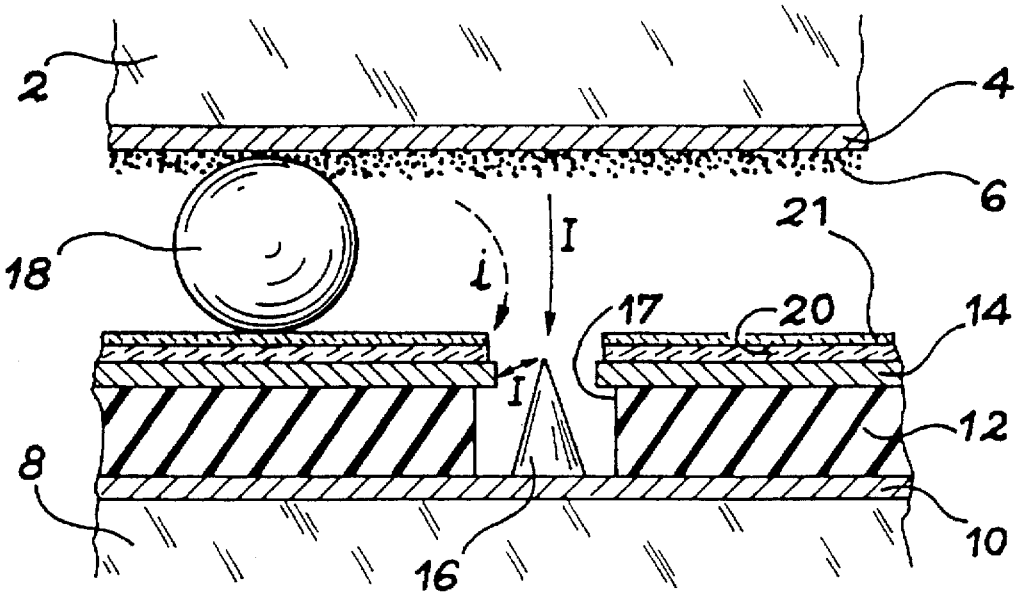
FIG. 2 A partial, diagrammatic view of a microtip display device according to the invention.

The device according to the invention, which is diagrammatically and partially shown in FIG. 2, differs from the device according to FIG. 1 in that it also has a first thin layer 20 which is electrically insulating, formed on the grids and perforated facing the microtips, the first thin layer 20 serving to limit the current between the anode and the grids.

The device of FIG. 2 also has a second thin layer 21 covering the first thin layer 20 and which is sufficiently conductive to permit the flow of interfering electric charges liable to be created during the operation of the device and which also has holes facing the microtips. This second thin layer 21 prevents the disturbance, by the first thin layer 20, of the electric field created between the microtips and the grids when the device is in operation. It is noted that no means for polarizing the second thin layer 21 are provided, therefore the second thin layer 21 is unpolarized. The second thin layer 21 is preferably resistive in order to only permit the flow of the parasitic or interfering charges. The device can have on the grids 14 a first thin layer 20 which is electrically insulating, e.g. of silica or silicon nitride, and a second thin layer 21 which is resistive, e.g. of resistive silicon or $SnO_2$.

In a not shown variant, there is no second thin layer 21 and, for avoiding the disturbance of the electric field, the diameter of the holes formed in the first thin layer 20 is greater than that of the holes formed in the grids.

It is also possible to produce a device according to the invention in which the second thin layer 21 is present and the diameter of the holes formed in the layer 20 is greater than that of the holes formed in the grids.

A dotted line arrow in FIG. 2 symbolizes the limited current i between the anode and the grids. This limitation in itself constitutes a very significant improvement. However, nothing is provided for limiting the current between the anode and the microtips and between the grids and the microtips.

It is for this reason that the invention is preferably applied to micro-tip display devices, whose electron source has a resistive layer between the cathode conductors and the microtips resting on the resistive layer. Such an electron source is described in the aforementioned documents (2) and (3).

Figure 3:
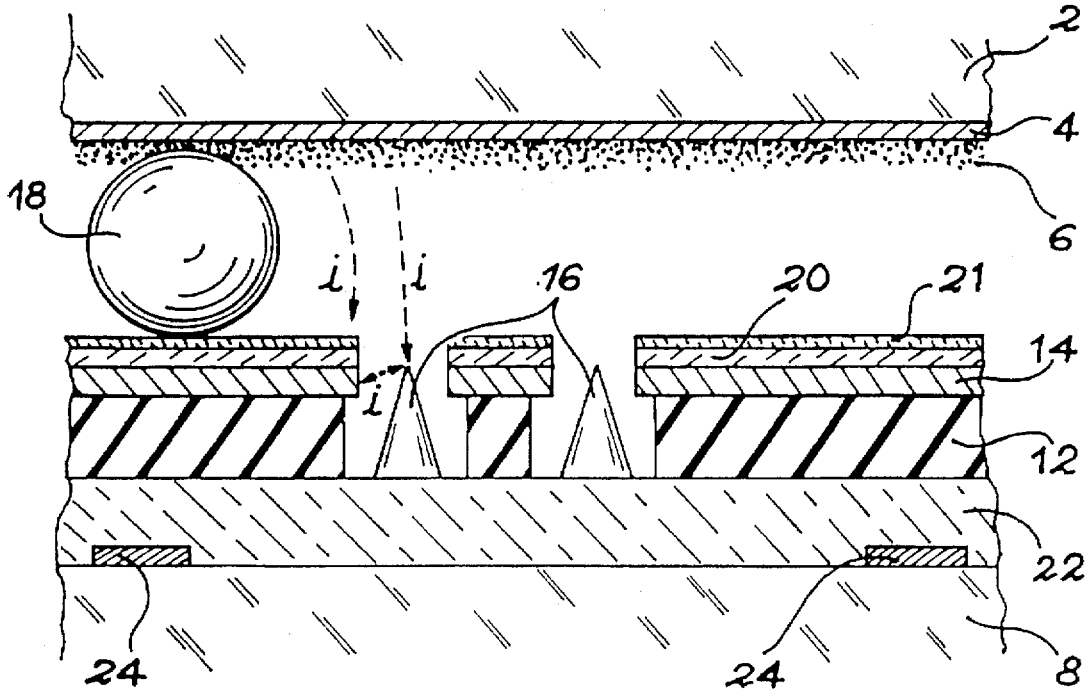
FIG. 3 A partial, diagrammatic view of another device according to the invention, in which a resistive layer is formed on the cathode conductors.

FIG. 3 is a partial, diagrammatic view of a device according to the invention, which incorporates a resistive layer 22 between the cathode conductors 24 and the microtips 16. The device of FIG. 3 differs from that of FIG. 2 by the fact that it has a resistive layer 22 between the insulating layer 12 and the cathode conductors 24, which are in this case meshed as in document (3).

As a result of the first thin layer 20 formed on the grids and the resistive layer 22 formed on the cathode conductors 24, all the currents i (between the anode and the grids, between the anode and the microtips and between the microtips and the grids) are controlled and limited. Therefore the device is protected against all short-circuit risks.

The most important advantage of the invention is that it makes it possible to increase the anode voltage end optionally reduce the space between the anode and the microtip electron source without any risk of an electrical accident liable to destroy the device.

Figure 4:
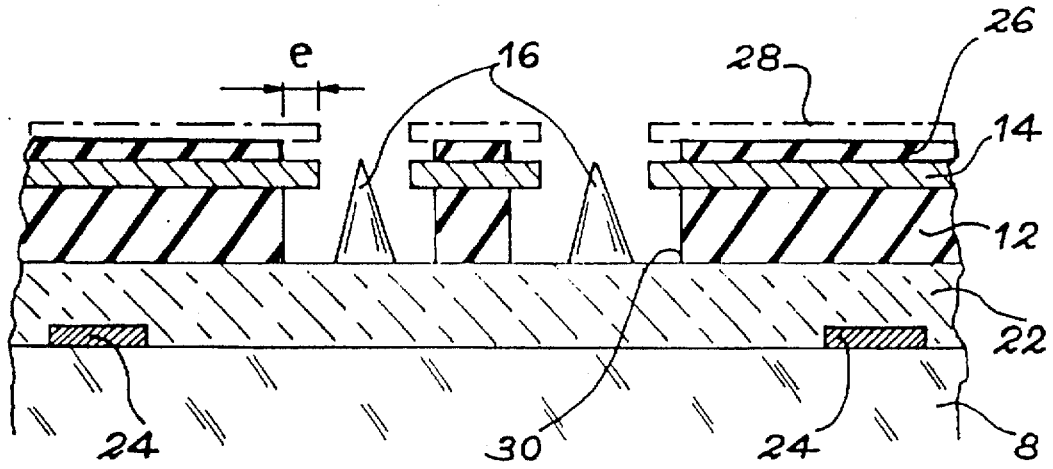
FIG. 4 A partial, diagrammatic view of another device according to the invention, in which the insulating layer formed on the grids is overetched.
Figure 5:
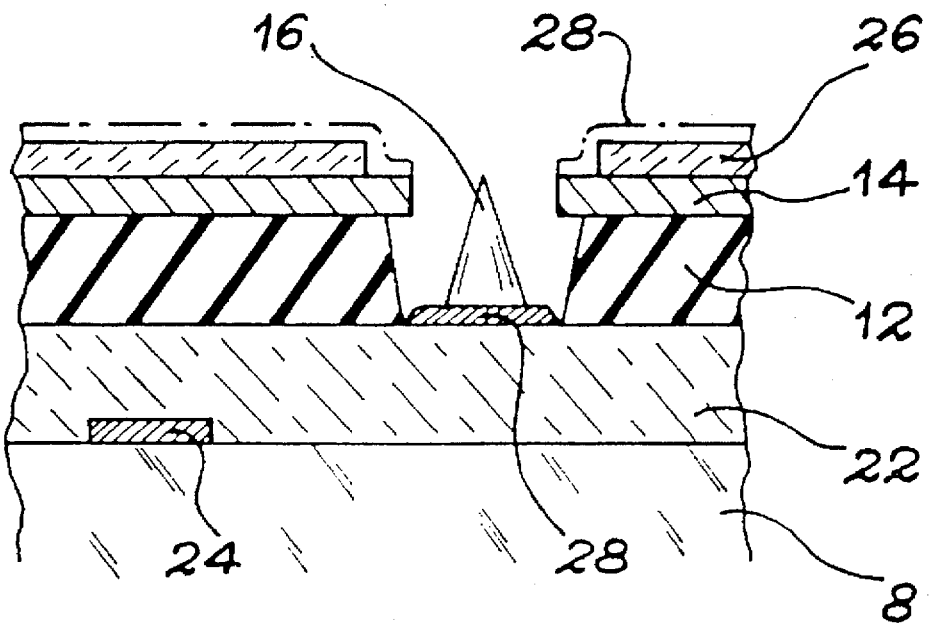
FIG. 5 A partial, diagrammatic view of another device according to the invention, in which a thin electrically conductive layer is deposited following the etching of the holes of the device.

In a purely indicative and in no way limitative manner, examples are given with reference to FIGS. 4 and 5 of a process for the production of microtip display devices according to the invention. While the process of each example is described with regard to the device of FIG. 3, each process is equally applicable to the device of Fig. 2.

In these examples:

the cathode conductors, such as the cathode conductor 24, are made from niobium, have a thickness of 0.2 μm and a lattice structure e.g. with square meshes, whose spacing is 25 μm and the cathode conductors are etched in order to form the columns of the device;

the resistive layer 22 is of phosphorus-doped, amorphous silicon and is deposited on the cathode conductors and the thickness of the resistive layer is approximately 1 μm;

the insulating layer 12 is of silica and is deposited on the silicon resistive layer 22 and the thickness of the insulating layer 12 is also approximately 1 μm; and a metallic layer 14 of niobium forming the grid layer is deposited on the silica insulating layer 12 and the thickness of said metallic layer is approximately 0.4 μm and is etched in order to form the grids in accordance with the rows of the device.

In a first embodiment of the process, a first thin layer 26 (FIG. 4) of insulating silica is deposited on the grids 14. The thickness of the first thin layer 26 is e.g. 0.2 μm. The first thin layer 26 can be produced by chemical vapour phase deposition, cathodic sputtering or any other thin film deposition method.

A sufficiently conductive, second thin layer 28, e.g. of niobium, molybdenum or $SnO_2$, is then deposited on the silica first thin layer 26 in order to permit the production of microtips and possibly the flow of parasitic or interfering charges during the operation of the device.

The thickness of the second thin layer 28 is e.g. 50 nm. The second thin layer 28 is preferably formed by evaporation using an electron gun, or by sputtering.

In the considered embodiment, use is made of cathode conductors forming meshes, holes with a diameter of approximately 1.4 μm being etched in the second thin layer 28, the insulating layer 12, the grid layer 14 and the first thin layer 26, within the meshes of the cathode conductors, or more precisely perpendicular to the regions defined by the meshes.

It is possible to use a wet or a dry etching process. Preference is given to the use of a reactive ionic etching process for the etching of the metallic layers and the insulating layers.

In preferred manner, there is a chemical overetching of the silica of the insulating layer 12, the overetching being e.g. of a few hundred nanometers (length e of FIG. 4), which makes it possible to enlarge the holes with respect to the insulating layer 12.

Such an overetching process is known and avoids the metallization of the edges of the holes in the silica during the production of the microtips.

Advantageously, there is an overetching of the first thin layer 26 in order to make it possible to free the grids around the holes 30 and therefore avoid a disturbance of the electric field (during the operation of the device) between the microtips 16 and the grids, the disturbance being caused by a charging phenomenon of the first thin layer 26 because it is electrically insulating.

It is possible at the same time to carry cut the overetchings of the layers 12 and 26, when the latter are made from the same material, which is the case in the embodiment described.

The microtips 16 are then produced in accordance with the process described in document (1).

The second thin layer 28 permits a better adhesion of a not shown, nickel layer used during the production of the microtips (cf. document (1)) and ensures electrical continuity during the electrochemical dissolving phase for the nickel.

Once the microtips have been produced, the contacts of the row conductors and the column conductors are, if necessary, released.

The second thin layer 28 can optionally be eliminated by an appropriate etching.

Another embodiment will now be described relative to FIG. 5. In this embodiment, the second thin layer 28 (sufficiently conductive to permit the flow of charges) can be deposited after the etching of the holes so that the second thin layer 28 buries the first thin layer 26. The second thin layer 28 extends to the grid 14 through the holes in the first thin layer 26 and covers a portion of the grid 14 adjacent the holes in the grid 14. The second thin layer 28 also covers the resistive layer 22 at the bottom of the holes in the insulating layer 12, with the microtips 16 formed on the second thin layer 28.

FIG. 5 partly and diagrammatically illustrates this case, where the second thin layer 28 is deposited following the etching of the holes and it is possible to see the bottom of the holes covered with the second thin layer 28 (which covers the silica insulating layer 26 mentioned in connection with FIG. 4).

FIG. 5 also shows that the microtips 16 are located above the second thin layer 28.

The deposition of the second thin layer 28 after the etching of the holes avoids the etching of second thin layer 28. The portion of the second thin layer 28 at the bottom of the holes serves no operational function but its presence is not detrimental to the operation of the device. The presence of the second thin layer 28 at the bottom of the holes is solely related to the process used to obtain the second thin layer 28. Therefore, the second thin layer 28 at the bottom of the holes can be prevented by appropriate masking or by deposition of the second thin layer 28 under an oblique angle of incidence, or the second thin layer 28 at the bottom of the holes can be removed by appropriate etching, so that the microtips 16 are formed on either the cathode conductors 10 (with the device of FIG. 2) or the resistive layer 22 (with the device of FIGS. 3).

We claim:

1. Microtip display device comprising:

a first electrically insulating substrate carrying a cathodoluminescent anode;

a second electrically insulating substrate carrying a first series of parallel electrodes acting as cathode conductors and carrying electron emitter material microtips facing said first electrically insulating substrate, an electrically insulating layer on said cathode conductors, and a second series of parallel electrodes serving as a grid placed on said insulating layer, said insulating layer and the grid having holes for passage of the microtips;

a first thin layer which is electrically insulated and disposed on said grid for limiting electric current liable to flow between the cathodoluminescent anode and the grid and preventing occurrence of an electric arc between said anode and said grid, said first thin electrically insulating layer having holes facing the microtips; and a second thin layer which is resistive and covering said first thin layer, said second thin layer being sufficiently conductive for permitting flow of interfering electric charges created during operation of said device to avoid a disturbance, by said first thin layer, of an electric field created between the microtips and the grid, said second thin layer having holes facing the microtips.

2. Device according to claim 1, wherein said holes formed in said first thin layer have a diameter which exceeds a diameter of the holes formed in the grid, in order to prevent the disturbance of the electric field created between the microtips and the grid, said first thin layer thus being overetched.

3. Device according to claim 2, wherein said second thin layer extends to said grid through said holes in said first thin layer and covers a portion of said grid adjacent said holes in said grid.

4. Device according to claim 1, further comprising a resistive layer between each cathode conductor and corresponding microtips.

5. Device according to claim 4, wherein said second thin layer extends to said grid through said holes in said first thin layer and covers said resistive layer within said insulating layer holes, and said microtips are disposed on said second thin layer within said insulating layer holes.

6. Device according to claim 1, wherein said second thin layer is unpolarized.

7. Microtip display device comprising:

a first electrically insulating substrate carrying a cathodoluminescent anode;

a second electrically insulating substrate carrying a first series of parallel electrodes acting as cathode conductors and carrying electron emitter material microtips facing said first electrically insulating substrate, an electrically insulating layer on said cathode conductors, and a second series of parallel electrodes serving as a grid placed on said insulating layer, wherein said insulating layer and the grid include holes for passage of the microtips;

a first thin layer which is electrically insulating and on said grid for limiting electric current liable to flow between the cathodoluminescent anode and the grid and preventing occurrence of an electric arc between said anode and said grid, said first thin layer having holes facing the microtips; and a second thin layer covering said first thin layer and extending to said grid through said holes in said first thin layer, said second thin layer being sufficiently conductive for permitting flow of interfering electric charges created during operation of said device to avoid a disturbance, by said first thin layer, of an electric field created between the microtips and the grid, said second thin layer having holes facing the microtips.

8. Device according to claim 7, wherein said holes in said first thin layer have a diameter which exceeds a diameter of the holes formed in the grid, in order to prevent the disturbance of the electric field created between the microtips and the grid, said first thin layer thus being overetched.

9. Device according to claim 8, wherein said second thin layer also covers a portion of said grid adjacent said holes in said grid.

10. Device according to claim 7, further comprising a resistive layer between each cathode conductor and corresponding microtips.

11. Device according to claim 10, wherein said second thin layer covers said resistive layer within said insulating layer holes, and said microtips are disposed on said second thin layer within said insulating layer holes.

12. Device according to claim 7, wherein said second thin layer is unpolarized.

13. Device according to claim 7, wherein said second thin layer is resistive.

* * * * *